US007607400B2

(12) United States Patent
Scotti

(10) Patent No.: US 7,607,400 B2
(45) Date of Patent: Oct. 27, 2009

(54) BOARDING SYSTEM WITH RETRACTABLE LADDER FOR YACHTING BOATS

(75) Inventor: Marino Douglas Scotti, Milan (IT)

(73) Assignee: Douglas Marine S.r.l., Milan (IT)

( * ) Notice: Subject to any disclaimer, the term of this patent is extended or adjusted under 35 U.S.C. 154(b) by 105 days.

(21) Appl. No.: 11/421,580

(22) Filed: Jun. 1, 2006

(65) Prior Publication Data

US 2006/0272567 A1 Dec. 7, 2006

(30) Foreign Application Priority Data

Jun. 1, 2005 (IT) ..... MI2005A1028

(51) Int. Cl.
*B63B 17/00* (2006.01)

(52) U.S. Cl. ..... 114/362

(58) Field of Classification Search ..... 114/362; 182/88

See application file for complete search history.

(56) References Cited

U.S. PATENT DOCUMENTS 2,840,290 A * 6/1958 Roberts ..... 182/97
3,035,283 A * 5/1962 Mott ..... 114/348
3,291,258 A * 12/1966 Twilley ..... 182/211
4,788,926 A * 12/1988 Ullman et al. ..... 114/219
4,811,817 A * 3/1989 Geary ..... 182/76
5,427,049 A 6/1995 Mardikian ..... 114/362
6,755,146 B1 6/2004 Garelick et al. ..... 114/362
7,182,175 B1 * 2/2007 Schmitt et al. ..... 182/88
2005/0016439 A1 1/2005 Mardikian et al. ..... 114/362
2005/0081775 A1 * 4/2005 Blank ..... 114/362

* cited by examiner

*Primary Examiner*—Stephen Avila
(74) *Attorney, Agent, or Firm*—Seed IP Law Group PLLC

(57) ABSTRACT

Boarding systems for retractable ladder boats comprising a stern platform and a retractable ladder; a water-tight casing-sheath for said ladder, equipped, inside, with sliding guides and incorporated in the stern platform, comprises a plurality of sliding slides, housed and limited inside the casing-sheath. The stern platform favors a receiving space, provided inside or outside, for receiving the casing-sheath and its optimal fixing. The sliding slides have a free stroke on the entire length of the sliding guides since such free stroke is limited at the ends of the sliding guides opening out on the opening port, through locking elements that allow the sliding slides to partially slip out from the sliding guides. The casing-sheath is retractably housed inside the housing space, formed in the stern platform.

11 Claims, 4 Drawing Sheets

BOARDING SYSTEM WITH RETRACTABLE LADDER FOR YACHTING BOATS

FIELD OF THE INVENTION

The present invention relates to a boarding system for yachting boats comprising a stern platform and a telescopic ladder slidably engaged in guides of said platform, to be moved from an inoperative position withdrawn beneath the platform to an operative position projecting therefrom.

Boarding systems of this type are commonly referred to as boarding systems with retractable ladders.

In particular, this invention concerns a boarding system of the aforementioned type wherein the ladder, when in inoperative position, is retractably inserted in the respective sliding guides.

Even more specifically, the invention relates to a boarding system wherein the respective ladder has uprights of the type extending telescopically, so as to be closed substantially in a pack when it is in the inoperative position.

PRIOR ART

Generally, known boarding systems for yachting boats and the like, provide a pair of sliding guides on the bottom surface of the stern platform wherein a retractable ladder of the type considered above is slidably engaged. The term stern platform is used to indicate a cantilevered footboard, generally made of fibreglass or wood, located at the stern of the boat.

During sailing the retractable ladder remains retractably inserted in the sliding guides, so that it practically adheres to the stern platform.

When necessary, such ladder is extracted from the sliding guides, up to the stroke end, and directed in such a way as to ease the boarding. In particular, retractable ladders are known whose uprights are telescopically extendible so as to make their extraction and directing easier since the extraction of the first telescopic element is followed by a cascade extension of the other telescopic elements.

Although advantageous from different points of view, boarding systems of the type considered have recognised drawbacks, highlighted hereafter. Firstly, the ladder is entirely made of steel, to resist corrosion, and the sliding means are in the form of pins sliding through opposite elongated slits, formed in relative sides that laterally define the ladder. The processing involved in the formation of such slits in the steel sides is complex and particularly expensive, as it is carried out through milling or laser cutting.

Moreover, exposure to the marine environment and to frequent intense contact with water of the mobile components involved in the sliding and the extension of the retractable ladder, reduces, over time, the reliability and functionality of said ladder.

Another drawback consists in the laboriousness, if not even difficulty, of mounting a retractable ladder onto the respective stern platform above all when the latter is made of fibreglass that, as known, generally has a bottom wall that is not flat but variously profiled.

Another noteworthy drawback consists in that the retractable ladder applied to a stern platform forms a substantial element of discontinuity on it that is not always acceptable both from the functional and from the aesthetic point of view.

The technical problem underlying the present invention is that of devising a boarding system for boats with a retractable ladder, having such structural characteristics as to allow a safe application to the stern platform overcoming the limitations and/or drawbacks still limiting what has been realized according to the prior art.

SUMMARY OF THE INVENTION

The aforementioned technical problem is solved by a boarding system of the type previously indicated, an embodiment of which is characterized in that it comprises a substantially flat, box-shaped casing-sheath for retractably receiving said ladder in the inoperative position, said casing being equipped, inside and on opposite sides, with sliding guides for said ladder.

The characteristics and advantages of the device according to the invention shall become clearer from the following description of an embodiment thereof, given for illustrating and not limiting purposes with reference to the attached drawings.

DETAILED DESCRIPTION

Figure 1:
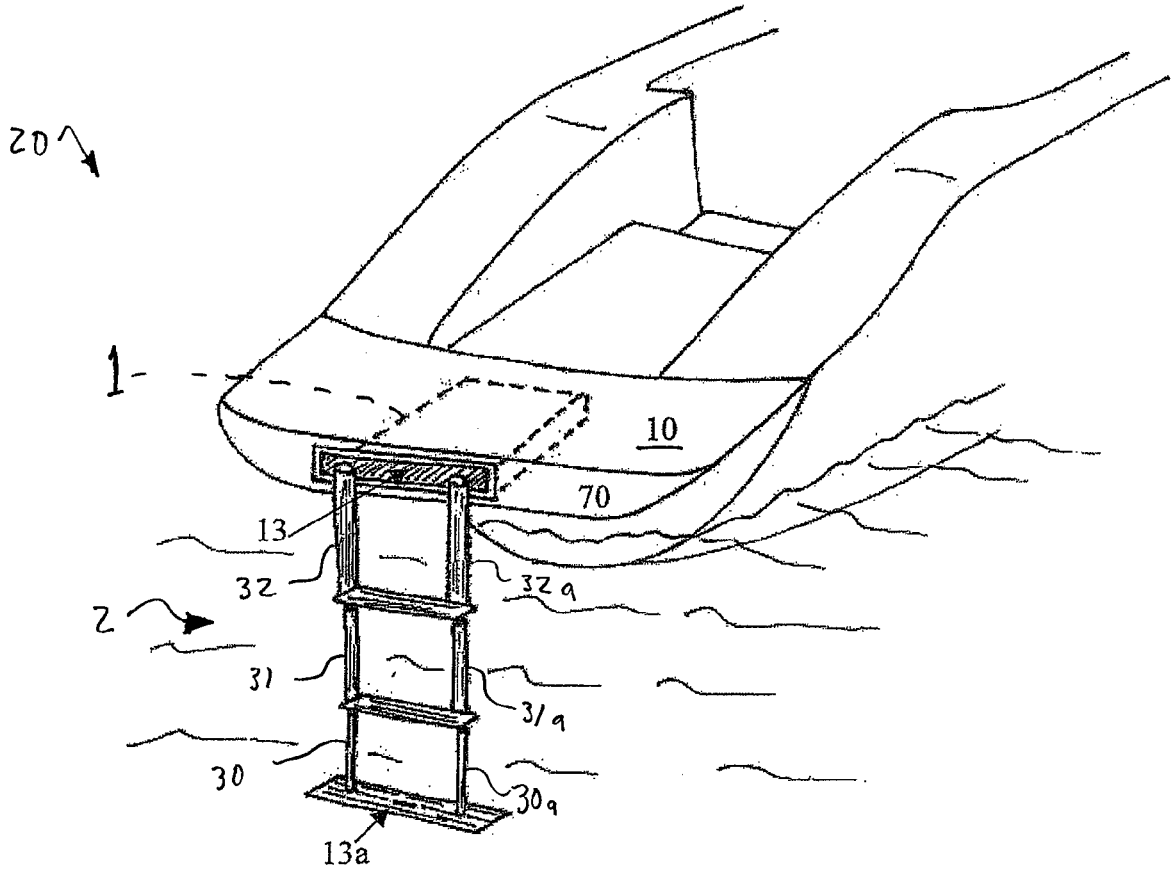
FIG. 1 schematically represents a perspective view of a boarding system of a boat according to one particular embodiment of the present invention, the boarding system being illustrated in an operative configuration.

With reference to FIG. 1, a boarding system made according to the present invention for yachting boats and the like comprising a stern platform 10 and a retractable ladder 2 is schematically represented and globally indicated with 20.

The ladder 2 is of the known type wherein the uprights consist of respective pluralities (three in the attached figures) of tubular pieces 30, 31, 32 and 30*a*, 31*a*, 32*a*, associated together in a telescopic extension. A respective step is fixed to pairs of opposite uprights; the ladder 2, when in "inoperative" condition, can be telescopically retracted and closed substantially in a pack.

In accordance with the present invention the boarding system 20 comprises a flat box-shaped casing-sheath, substantially retractable to receive said ladder 2 in the inoperative condition, as it shall be clearer hereafter in the description.

Advantageously, the box-shaped casing 1 is, in use, the only structure being internally subject to the presence of water by spilling or overflowing, but allows the inside of the space of the stern platform it is associated with to be kept dry.

Figure 4:
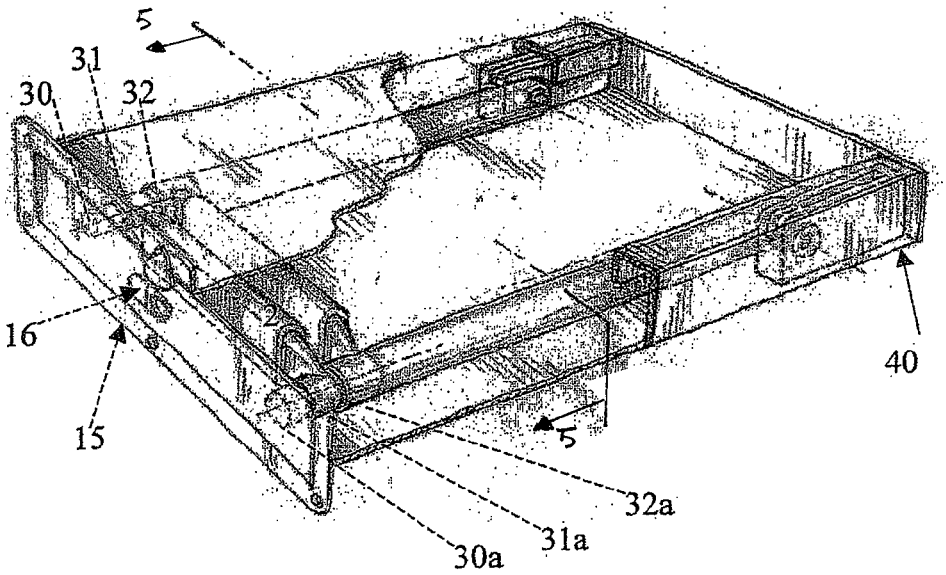
FIG. 4 represents a partially exposed perspective view of the boarding system of FIG. 2.
Figure 5:
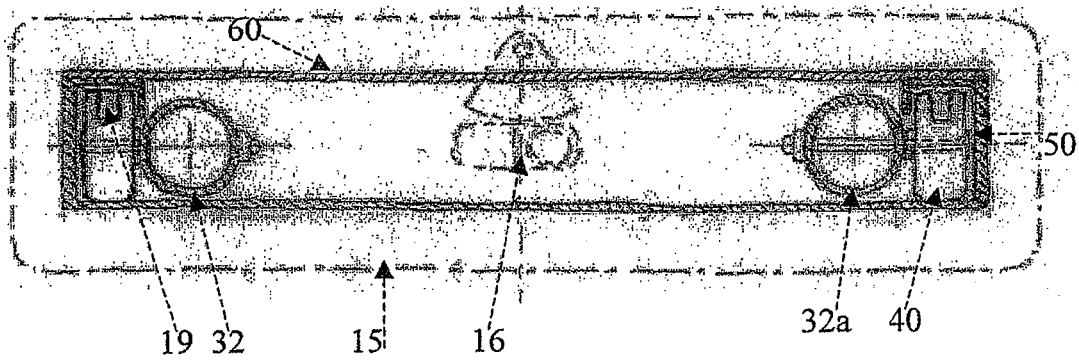
FIG. 5 represents a cross-sectional view of the boarding system of FIG. 4, viewed along Section 5-5.

In particular, the box-shaped casing-sheath 1 is equipped with a front opening or mouth 13 for accessing its inside, sized so as to allow the passage of the retractable ladder 2 during the operations of insertion and removal of the same into and from said casing-sheath 1. The latter is also equipped with a riser/cover 13*a*, equipped with a manually actuated handle 15 (FIG. 4) for removing the ladder. In the illustrated embodiment, when the ladder 2 is in the operative configuration, the riser/cover 13*a* serves as the bottom riser for the ladder; when the ladder is in the inoperative configuration, the riser/cover 13*a* serves as a cover over the mouth 13 of the casing-sheath 1.

The casing-sheath 1 is internally equipped, on opposite sides, with guides 50 (FIG. 6), whereon the retractable ladder 2 is slidably engaged. Advantageously, according to the present invention, said guides 50 are obtained through undercut bending of the side walls of the casing 1 so as to form the guides 50*a* having a C-shaped section open towards the ladder and the space inside the casing.

A cover 13*a* is fixed, tightly resting, onto the outer edge of said guides 50*a* to ensure the tightness of the casing 1.

In the guides 50*a* corresponding slides 40 (FIG. 6) are engaged, the respective inner ends of uprights 32, 32*a* of the telescopic ladder 2 are associated with and fixed thereto. When the ladder 2 is in the inoperative configuration and completely retracted in the casing 1 the slides 40 and the relative ends of the uprights 32,32*a* associated therewith are nested in the distal end of the guides 50 with respect to the mouth 13 of the casing 1.

It should be noted that the stroke of the slides 40 on the entire length of the respective guides 50 is limited at the mouth 13.

Figure 6:
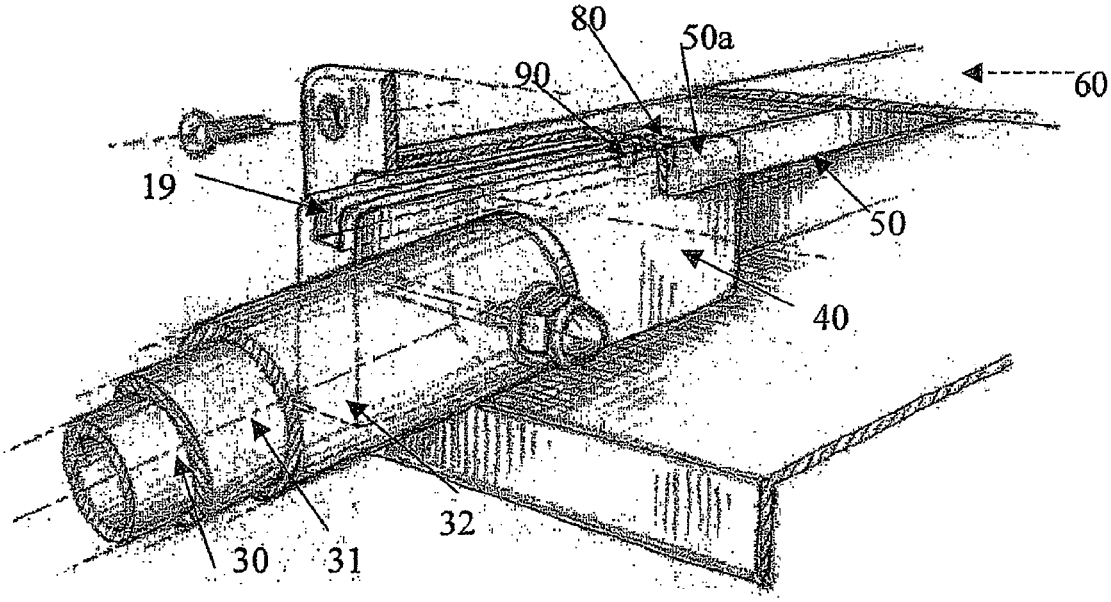
FIG. 6 represents an enlarged partial section perspective view of the boarding system of FIG. 1.

In particular, in accordance with a preferred embodiment, the slides 40, can be made of an appropriate plastic material, water-resistant and suitable for sliding, for example nylon, are equipped, on top, with a groove 19 (FIG. 6), not defined on their entire length but interrupted to form an rebate step 80 (FIG. 6).

A pin 90 (FIG. 6) is provided projecting towards the inside of each guide 50 near the end thereof towards the mouth 13. The pin 90 is intended to constitute a beat against the aforementioned rebate step 80 to prevent the slide 40 and the corresponding upright 32, 32*a* from slipping out of the casing 1, while it is free inside the guides 50 up to a stroke end position near the mouth 13.

Such stroke end position is also advantageous for the mounting of the retractable ladder 2 onto the slides 40, also promoting the interchangeability of the retractable ladder 2 with other retractable ladders, for example with more or fewer steps, without requiring the removal of the casing-sheath 1 from the stern platform 10.

Advantageously, and in accordance with a further preferred embodiment, the most outer step of the retractable ladder 2 is structured and sized to carry out the function of a riser 13*a* with handle 15. Optionally, such step may be structured for a water-tight closing of the casing-sheath 1.

Figure 3:
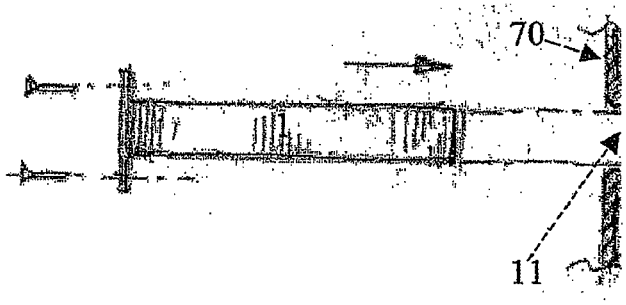
FIG. 3 represents a side view of the boarding system of FIG. 2.

The boarding system 20 can be inserted through an opening 11 (FIG. 3) formed on an outer edge 70 of the stern platform 10 of the yachting boat, so that the mouth 13 thereof is preferably flush with the front opening 11.

To ensure the water-tightness between the casing 1 and the inner space of the stern platform 10, said casing 1 is perimetrically equipped, at its mouth 13, with a flat edge 12 (FIG. 2) constituting a flange for fixing to the outer edge 70 of the stern platform 10, when the casing is positioned in the space 11.

Figure 2:
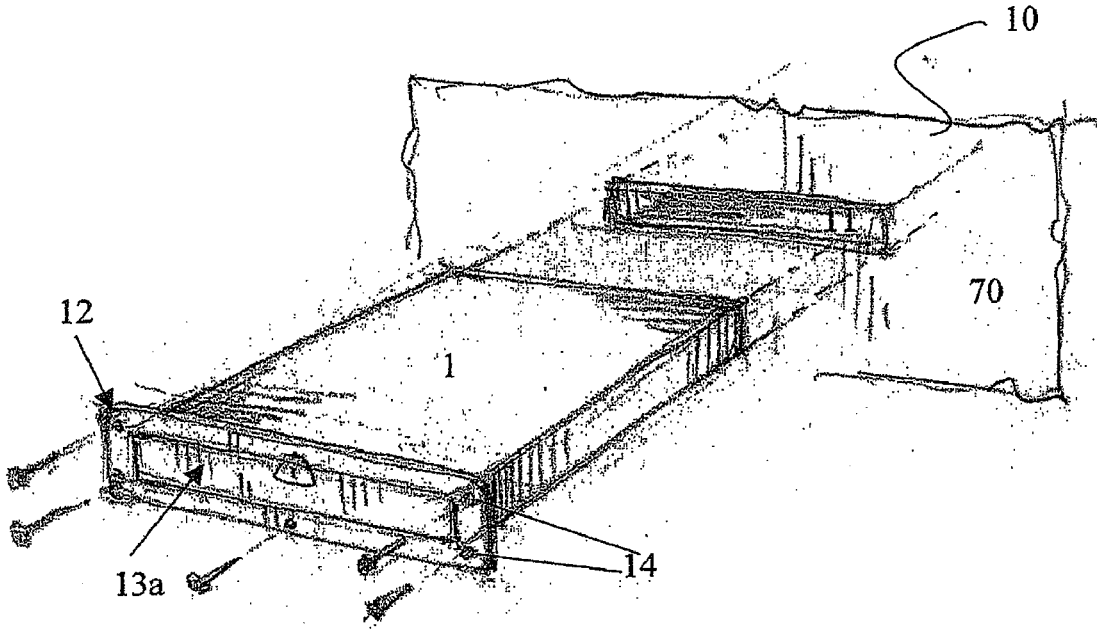
FIG. 2 represents an exploded, enlarged perspective view of the boarding system of FIG. 1, the boarding system being illustrated in an inoperative configuration.

The fixing occurs, according to what is shown in FIG. 2, through insertion of screws in the through holes 14 present along the edge-flange 12 and their tightening into corresponding threaded holes provided in the stern platform 10.

The fixing, quoted above by way of non-limiting example, alternatively occurs by engagement and hooking of the casing-sheath 1 through the opening 11, so as not to require further fixing or screwing elements.

In conclusion, boarding systems according to embodiments of the invention allow a retractable ladder to be removably mounted onto a stern platform, retaining the structural characteristics of the platform itself, eliminating any encumbrance constituted by the retractable ladder in conventional boarding systems, cause of dangerous projections and aerodynamic resistance, enclosing in a casing that can on the inside come into contact with water but that keeps the space inside the stern platform of fibreglass boats dry.

The invention claimed is:

1. A boarding system for yachting boats and the like comprising: a stern platform and a telescopic ladder formed by tubular pieces slidably engaged in telescopic extension in guides of said platform, to be moved from an inoperative, retracted position on the platform to an operative position projecting therefrom, wherein said boarding system also comprises a substantially flat box-shaped casing-sheath adapted to be inserted through an opening of said boat for retractably receiving said ladder in the inoperative position, said casing-sheath being equipped, inside and on opposite sides, with sliding guides for said retractable ladder, wherein respective sliding slides are housed in said sliding guides and each of them is associated with a corresponding upright of said ladder, wherein at least one pin projects towards the inside of each of said sliding guides near the end thereof opening out towards said mouth and constitutes abeat against rebate step defined on a corresponding slide, to prevent said slides and the corresponding end of the upright from slipping out, wherein said rebate step allows said sliding slides to partially slip out from said sliding guides at said mouth.

2. A boarding system according to claim 1, wherein said casing-sheath is equipped with a mouth for accessing its inside, closed by a respective riser.

3. A boarding system according to claim 2, wherein said riser is a step of said retractable ladder.

4. A boarding system according to claim 2, wherein said casing-sheath is retractably inserted through said opening on an outer edge of the stern platform and is perimetrically equipped, at said mouth, with a flat edge-flange for water-tight coupling to said outer edge, when said casing-sheath is placed inside said opening.

5. A boarding system according to claim 1, wherein said riser comprises a handle for the extraction of the telescopic ladder.

6. A boarding system for a floating vessel comprising:

a substantially flat box-shaped casing-sheath adapted to be inserted into an opening in a stern platform, the casing-sheath comprising an inner portion and two opposing side walls, wherein each of the two opposing side walls comprises a sliding guide configured for guiding a corresponding slide along an inner length of the casing-sheath, wherein the sliding guides are formed from curved portions of the respective opposing side wall; and a retractable ladder comprising two opposing sets of telescopic tubular pieces configured to telescopically nest and configured to be rotatably coupled to the corresponding slides on the respective side walls of the casing-sheath, wherein the retractable ladder is configured to be guided by the slides on the sliding guides of the casing-sheath, wherein the retractable ladder is configured to be moved from an inoperative, retracted position within the casing-sheath and within the opening of the stern platform to an operative position projecting from the casing-sheath and from the opening of the stern platform.

wherein the casing-sheath further comprises at least one pin projecting towards an inside of each of the sliding guides near an end thereof opening out towards a receiving portion of the casing-sheath, wherein each pin is configured to prevent a corresponding slide within the sliding guide and a corresponding end of the retractable ladder from detaching from the casing-sheath, wherein the at least one pin projecting towards the inside of each of said sliding guides each constitute abeat against a rebate step defined on a corresponding slide, and wherein the rebate step allows the slide to partially slip out from the corresponding sliding guide at the receiving portion of the casing-sheath.

7. A boarding system according to claim 6, wherein the casing-sheath comprises an open front portion configured to be closed by a riser.

8. A boarding system according to claim 7, wherein the riser is a step of the retractable ladder.

9. A boarding system according to claim 7, wherein the riser comprises a handle for extraction of the retractable ladder from the casing-sheath.

10. A boarding system for a floating vessel comprising:

a substantially flat box-shaped casing-sheath adapted to be inserted into an opening in a stern platform, the casing-sheath comprising an inner portion and two opposing side walls, wherein each of the two opposing side walls comprises a sliding guide configured for guiding a corresponding slide along an inner length of the casing-sheath, wherein the sliding guides are formed from curved portions of the respective opposing side wall, wherein the casing-sheath is retractably inserted through the opening on the stern platform on an outer edge of the stern platform, and the open front portion of the casing-sheath is perimetrically equipped with a flat edge-flange configured to provide a water-tight coupling to the outer edge when the casing-sheath is placed inside the opening of the stem platform; and a retractable ladder comprising two opposing sets of telescopic tubular pieces configured to telescopically nest and configured to be rotatably coupled to the corresponding slides on the respective side walls of the casing-sheath, wherein the retractable ladder is configured to be guided by the slides on the sliding guides of the casing-sheath, wherein the retractable ladder is configured to be moved from an inoperative, retracted position within the casing-sheath and within the opening of the stern platform to an operative position projecting from the casing-sheath and from the opening of the stern platform.

11. A boarding system according to claim 6, wherein said casing-sheath is water-tight.

* * * * *

UNITED STATES PATENT AND TRADEMARK OFFICE

CERTIFICATE OF CORRECTION

PATENT NO. : 7,607,400 B2
APPLICATION NO. : 11/421580
DATED : October 27, 2009
INVENTOR(S) : Marino Douglas Scotti It is certified that error appears in the above-identified patent and that said Letters Patent is hereby corrected as shown below:

Column 6
Line 8, "ing of the stem platform; and" should read --ing of the stern platform; and--.

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,607,400 B2
APPLICATION NO. : 11/421580
DATED : October 27, 2009
INVENTOR(S) : Marino Douglas Scotti It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 253 days.

Signed and Sealed this

Twelfth Day of October, 2010

David J. Kappos

David J. Kappos
*Director of the United States Patent and Trademark Office*